US006375101B1

(12) United States Patent
Kelsey

(10) Patent No.: US 6,375,101 B1
(45) Date of Patent: Apr. 23, 2002

(54) GRINDING MILL

(75) Inventor: Christopher George Kelsey, Glenelg (AU)

(73) Assignee: Lowan (Management) PTY Limited, East GlenElg (AU)

( * ) Notice: Subject to any disclaimer, the term of this patent is extended or adjusted under 35 U.S.C. 154(b) by 0 days.

(21) Appl. No.: 09/486,374

(22) PCT Filed: Aug. 28, 1998

(86) PCT No.: PCT/AU98/00692

§ 371 Date: Feb. 28, 2000

§ 102(e) Date: Feb. 28, 2000

(87) PCT Pub. No.: WO99/11377

PCT Pub. Date: Mar. 11, 1999

(30) Foreign Application Priority Data

Aug. 29, 1997 (AU) ..... PO8835
Apr. 9, 1998 (AU) ..... PP3025

(51) Int. Cl.[7] ..... B02C 17/00
(52) U.S. Cl. ..... 241/30; 241/172; 241/176
(58) Field of Search ..... 241/172, 176, 241/177, 178, 30

(56) References Cited

U.S. PATENT DOCUMENTS 3,056,561 A * 10/1962 Hukki ..... 241/176
5,011,089 A 4/1991 Vock et al. ..... 241/21
5,158,239 A 10/1992 Vock et al. ..... 241/172
5,312,055 A 5/1994 Barthelmess et al. ..... 241/172

FOREIGN PATENT DOCUMENTS

| | | |
|---|---|---|
| DE | 196 14295 | 10/1996 |
| FR | 1 289 073 | 8/1962 |
| FR | 2 631 253 | 11/1989 |

* cited by examiner

*Primary Examiner*—Mark Rosenbaum
(74) *Attorney, Agent, or Firm*—Smith, Gambrell & Russell, LLP

(57) ABSTRACT

A grinding mill has a rotating container (40) into which particulate material is fed. The container is rotated above critical speed to form a layer which is retained under high pressure against the container inner surface. Shearing discs (58) mounted inside the container induce shearing of the layer to promote particle fracture by shearing and abrasion in the pressurised layer. Fine ground material travels axially to the container discharge end (64). In one form of the invention, the container is rotated at sufficient speed to form a series of solidified zones (70) alternated with stirred zones (72) next to non-rotating shearing discs (58). These solidified zones act as solid discs rotating with the container.

3 Claims, 3 Drawing Sheets

GRINDING MILL

BACKGROUND OF INVENTION

The invention relates to a rotary grinding mill for size reduction of particles such as ceramics, minerals and pharmaceuticals.

Prior art rotary mills include a cylindrical drum rotated about a generally horizontal axis. The rotating drum is fed with particulate material such as a slurry or powder, the rotation of the drum being at one half to three quarters of the "critical speed" (i.e. the minimum speed at which material at the inner surface of the drum travels right around in contact with the mill). This causes a tumbling action as the feed and any grinding media travels part way up the inner wall of the dram then falls away to impact or grind against other particles in the feed. Size reduction of the particles is thus achieved principally by abrasion and impact.

In conventional rotary mills, the energy requirements of the mill increases steeply with increasing fineness of grind. For applications where a fine grind is required, the use of stirred mills, in which a body of the particulate material is stirred to create shearing of particles and numerous low energy impacts, may be used to ameliorate this problem to some extent. However, the present application of stirred mills is constrained by reduction ratio boundaries imposed by both upper feed size limits and energy transfer inefficiencies at ultra fine sizes. These constraints, together with throughput limitations and media/product separation difficulties due to viscosity effects at ultra fine sizes, restricts the practical and economic scope for applying that technology.

SUMMARY OF THE INVENTION

The present invention aims to provide an alternative grinding mill construction.

The invention, in one form, provides a grinding mill for particulate material, including a rotary container having an inner surface, feed means for feeding the particulate material to the container, means rotating the container at a sufficiently high speed that the particulate material forms a layer retained against the inner surface throughout its rotation, and shear inducing means contacting said layer so as to induce shearing in said layer.

In non-vertical mills, the minimum rotational speed at which the particulate material rotates around in contact with the container is known as the "critical speed". That term is used herein with reference to both vertical and non-vertical mills as referring to the minimum rotational speed at which the particulate material forms a layer retained against the container inner surface throughout its rotation.

The invention also provides a grinding method in which particulate material is fed to a container rotated at above critical speed, so as to form a layer retained against the container throughout its rotation and inducing shear in said layer by shear inducing means contacting the layer.

Preferably, the shear inducing means is mounted inside and rotates relative to the container.

In a first embodiment, the shear inducing means rotates in the direction of rotation of the container, but at a different speed. In a second embodiment, the shear inducing means counterrotates relative to the container.

Alternatively, the shear inducing means can be non-rotational, relying on relative rotation with the container to induce shearing of the material layer.

Preferably also, the mill rotates at least three times, more preferably at least ten times, critical speed.

BRIEF DESCRIPTION OF THE DRAWINGS

Preferred embodiments will now be further described with reference to the accompanying drawings, in which.

DESCRIPTION OF PREFERRED EMBODIMENTS

Figure 1:
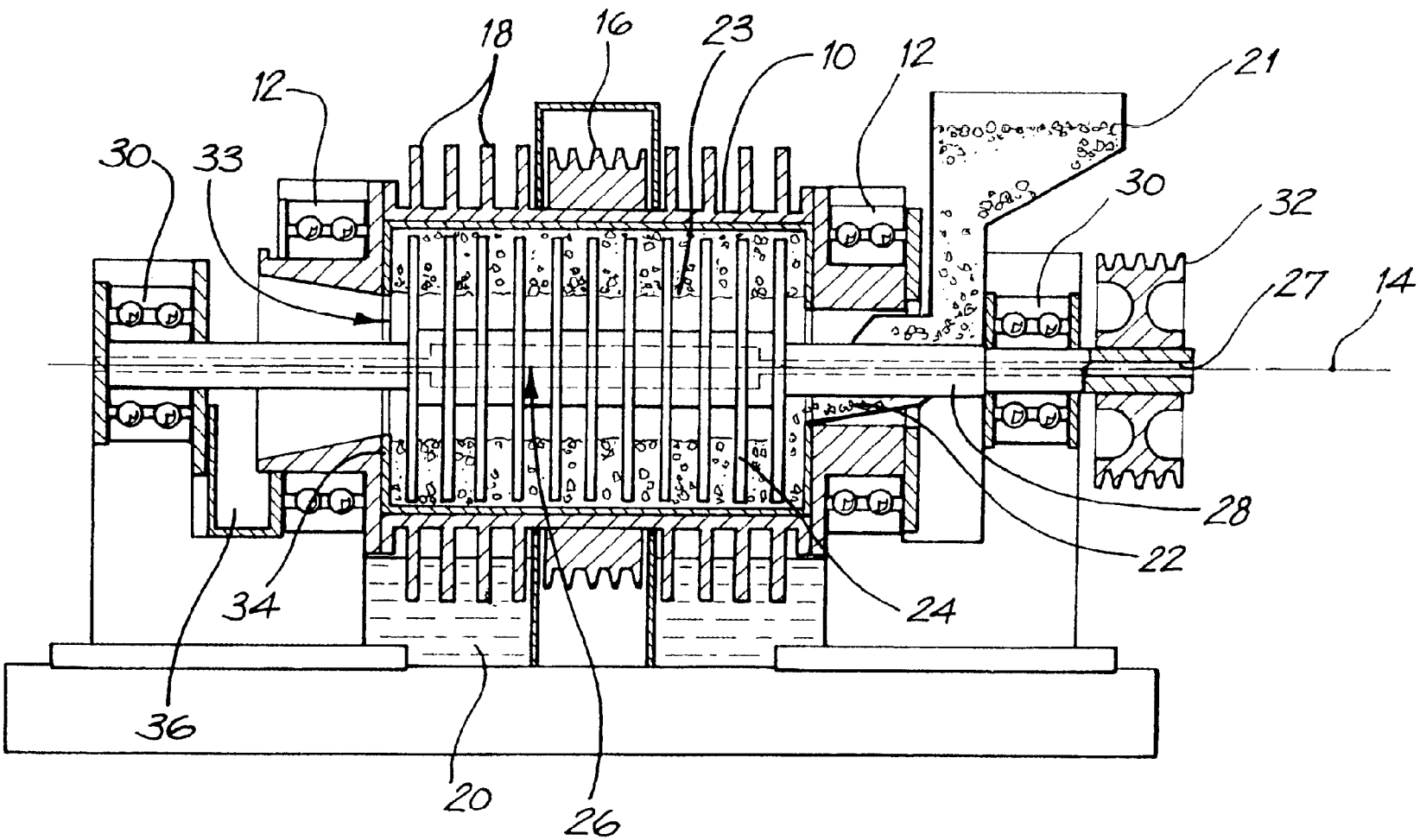
FIG. 1 is a schematic sectional elevation of a first embodiment.

The mill shown in FIG. 1 has a cylindrical outer drum 10 mounted on bearings 12 for rotation about its central axis 14, driven by means of drum drive pulley 16 attached to its outer surface. The drum outer surface also carries cooling fins 18 which pass through a cooling water trough 20 below the drum.

A feed of flowable particulate material, for example a slurry or powder, is introduced to one end of the drum from a feed hopper 21 via feed inlet 22 and is flung outwards to form a layer 23 against the inner surface of the drum. The drum is rotated sufficiently above critical speed that the entire mill charge, and any grinding media, travels right around in contact with the drum rather than the sub-critical tumbling operation of prior art mills. The drum is preferably rotated at least three times critical speed, most preferably at least ten times, so that the mill charge layer is at high pressure, compressed by the high centrifugal force. The magnitude of the compressive forces applied can be varied by varying the speed of rotation of the outer drum.

The charge layer is mobilised by disc or finger projections 24 of the counterrotating shear inducing member 26 inside the drum, mounted on a central shaft 28 supported in bearings 30. This shaft is rotated by means of a shaft drive pulley 32. A cooling water passage 27 extends through shaft 28.

For maximum shearing, the shaft is rotated rapidly in the opposite direction to drum 10. Alternatively, the shaft may be rotated in the same direction as the drum but at a differential speed. This latter arrangement eliminates a 'dead' locus within the charge layer at which the rotational "G" force is zero, and reduces energy requirements of the mill.

The particles in the charge layer are subjected to intense interparticle and/or particle to media shear stresses generated by the stirring action of the projections 24 rotating through the compressed charge layer. The high pressure due to rotation of the charge layer enhances energy transfer from the projections to the charge, thus transferring a relatively large proportion of the available input energy directly to the particles as fracture promoting stress.

The shearing of the compressed solids layer causes both shearing and abrasion fracture of the particles, with sufficient energy to cause localised stressing and fracture applied simultaneously to a large proportion of the total particle population within the mill. The net result is a high distribution of very fine particles, with the capacity to sustain effective fracture by this mechanism at high particle population expansion rates within the mill.

In addition to abrasion fracture, particles may also fracture due to compressive force of the media and sold particle bulk pressure, due to the exaggerated "gravitational" force within the mill. The magnitude of this compressive force and the particle/particle and particle/media packing densities may be varied. It is believed that some fracture by shatter and attritioning of particle surfaces resulting from higher velocity impacts also occurs, but to a lesser degree than abrasion fracture.

The discharge end 33 of the mill drum 10 has an annular retaining plate 34 extending radially inwards from the drum inner surface. The greater centrifugal force acting on the heavy media particles causes the media to be retained within the mill radially outwards of the retaining plate 34 and therefore kept within the mill while the fine product is displaced by the incoming feed and passes radially inwards of the retaining plate and into a discharge launder 36.

Figure 2:
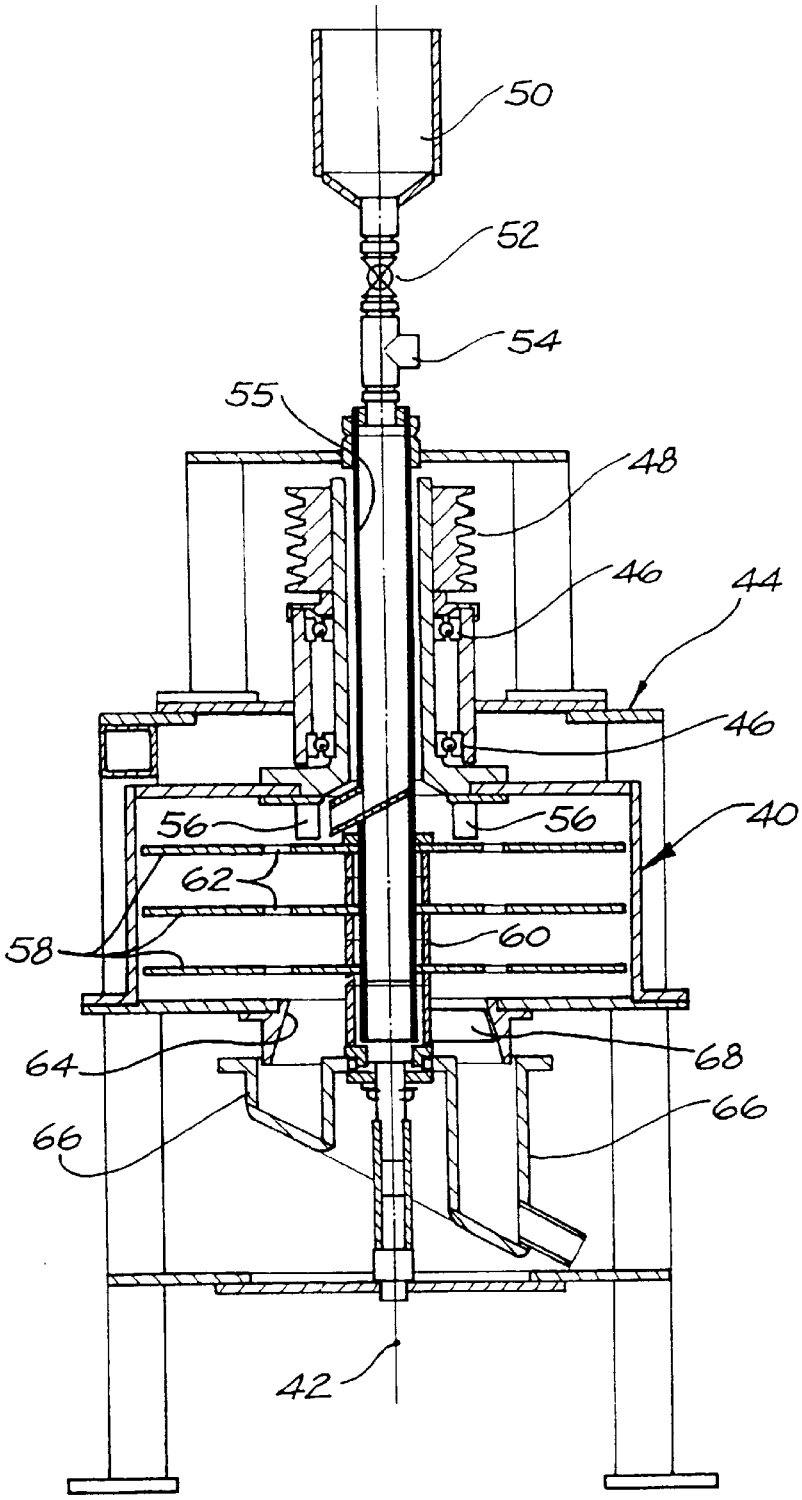
FIG. 2 is a schematic sectional elevation of a second embodiment.
Figure 3:
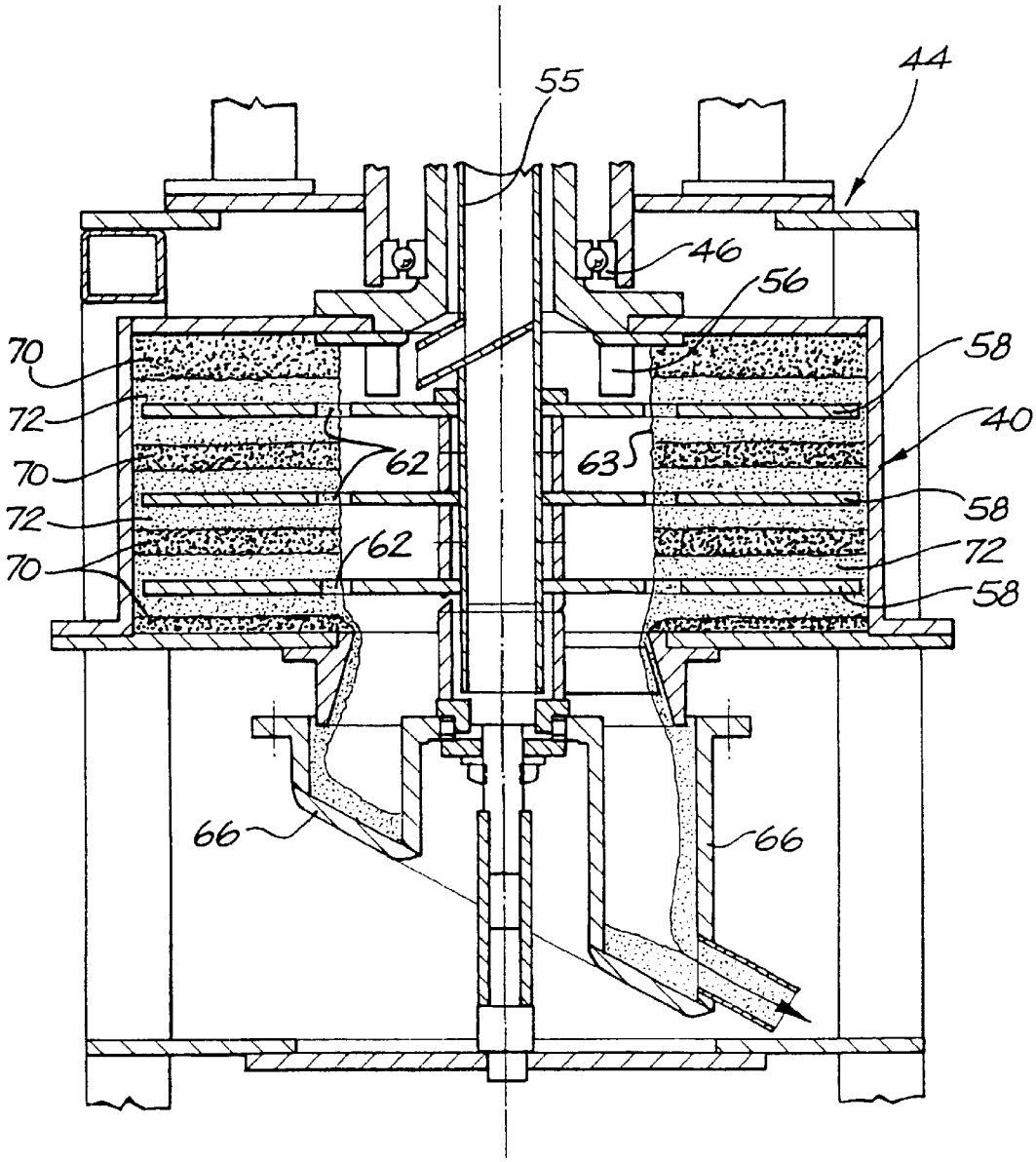
FIG. 3 is an enlarged sectional elevation of the grinding chamber of the FIG. 2 mill during operation, showing the creation of alternate stirred and dead zones within the chamber.

FIGS. 2 and 3 illustrate a vertical mill constructed in accordance with a second embodiment, including non-rotating shear members.

The rotating drum 40 of the mill is mounted on a vertical rotational axis 42, supported on frame 44 by bearings 46, and is rotated at high speed via the drum drive pulley 48.

The mill is charged initially with a mix of grinding media, fed from media hopper 50 via ball valve 52, and a feed powder or slurry fed through feed port 54. The charge passes down stationary feed tube 55 into the drum. Feed impellers 56 attached to the rotating drum impart rotary motion to the charge, which forms a highly compressed layer retained against the drum inner surface.

In the embodiment of FIGS. 2 and 3, the shear inducing member inside the drum is stationary, consisting of one or more radial discs 58 attached to a fixed shaft 60. The discs have apertures 62 in the region of the inner free surface 63 of the charge layer to allow axial movement of fine ground material through the mill to the discharge end. If fingers or other projections are used instead of discs 58, the apertures 62 are not required.

After the initial charge is introduced, no further grinding media is added but a continuous stream of feed is fed via feed port 54. The mill is adapted to receive feed slurries of high solids content, for example 50–90% solids, typically 55–75%, depending on the feed material and the size reduction required.

The grinding media and larger particles in the charge layer will tend not to move axially through the mill due the high compressive forces on the charge. Instead radial migration of particles occurs, wherein larger particles introduced in the feed slurry migrate radially outwards through the charge due to the high centrifugal force and are subject to grinding and fracturing by the efficient mechanisms discussed above with reference to FIG. 1. As the particle size reduces, the smaller particles migrate radially inwards until they reach the inner free surface of the charge layer, which equates to a zero (gauge) pressure locus.

The fine particles reaching the free surface may then move axially through the mill, through apertures 62 in the discs, pass radially inwards of the discharge ring 64 and into discharge launder 66. A scraper blade 68 may be affixed to stationary shaft 60 to keep the material flowing freely through the discharge ring, The applicant has found that, at the very high rotational speeds at which this mill is operated, preferably at least 100 times gravity, for example up to 200 times gravity, zones in the charge away from the shearing discs 58 pack solid and rotate at one with the rotating drum. This can be used to advantage by spacing the shearing discs apart by a sufficient distance to create solid 'dead' zones of charge between successive discs and Fan adjacent the end faces of the rotating drum. These dead zones 70, shown by the darker shading in FIG. 3, effectively act as solid discs extending inwards from the inner wall of the drum, parallel to and rotating at high speed relative to the discs. This creates an extremely high shear rate in the stirred charge regions 72 (shown in lighter shading in FIG. 3) adjacent the discs, while protecting the end surfaces of the drum against excessive wear.

The minimum disc spacing required to create this stirred zone/dead zone phenomenon will vary dependent on the rotational speed and charge material used, but in cases of extremely high G force and high solids content may be as little as 50 mm.

Compared to the FIG. 1 embodiment, the embodiment of FIGS. 2 and 3 has the advantage of lower power requirement as it is not necessary to drive the shear-inducing member. The power requirement of the mill may be further reduced by reducing the length of the grinding chamber and employing only a single shearing disc.

The high "gravity" environment within the mills according to the invention extends the practical and economic boundaries of conventional stirred mill comminution with respect to the feed top size, reduction ratios, energy efficiency and throughput.

While particular embodiments of this invention have been described, it will be evident to those skilled in the art that the present invention may be embodied in other specific forms without departing from the essential characteristics thereof. The present embodiments and examples are therefore to be considered in all respects as illustrative and not restrictive, the scope of the invention being indicated by the appended claims rather than the foregoing description, and all changes which come within the meaning and range of equivalency of the claims are therefore intended to be embraced therein.

What is claimed is:

1. A method of grinding particulate material, including feeding the particulate material to a container which has an inner surface, rotating the container at an operational speed that is at least three times the speed at which the particulate material forms a layer retained against the inner surface throughout its rotation, and contacting the layer with shear inducing means that are spaced axially along said container so as to create alternate solidified and stirred zones of said particulate material within the container when rotating at said operational speed.

2. A method of claim 1, wherein the operational speed is a sufficient speed to induce a force of at least 100 times gravity on the particulate material layer.

3. A method of claim 1, wherein the operational speed is at least 10 times a minimum speed at which the particulate material forms a layer retained against the container inner surface throughout its rotation.

* * * * *